US010525584B2

(12) United States Patent
Nordness

(10) Patent No.: US 10,525,584 B2
(45) Date of Patent: Jan. 7, 2020

(54) SCREW BIT HOLSTER

(71) Applicant: Shane Nordness, Solon Springs, WI (US)

(72) Inventor: Shane Nordness, Solon Springs, WI (US)

( * ) Notice: Subject to any disclaimer, the term of this patent is extended or adjusted under 35 U.S.C. 154(b) by 166 days.

(21) Appl. No.: 15/648,765

(22) Filed: Jul. 13, 2017

(65) Prior Publication Data

US 2019/0015966 A1 Jan. 17, 2019

(51) Int. Cl.
*B25H 3/00* (2006.01)

(52) U.S. Cl.
CPC ..... *B25H 3/003* (2013.01)

(58) Field of Classification Search
CPC .... B25H 3/003; B25B 23/0035; B25G 1/085; B23Q 3/1574
See application file for complete search history.

(56) References Cited

U.S. PATENT DOCUMENTS 4,463,788 A * 8/1984 Corona ..... B25G 1/085 81/177.4
5,065,498 A 11/1991 McKenzie
5,346,453 A 9/1994 Rivera-Bottzeck
7,954,649 B1 * 6/2011 Froehlich ..... B25H 3/003 211/163
8,231,512 B2 7/2012 Schmidt
2003/0079580 A1 * 5/2003 Beauchamp ..... B25F 5/029 81/490
2014/0299640 A1 * 10/2014 Escherich ..... B25H 3/003 224/183
2014/0329654 A1 11/2014 Andriolo et al.

OTHER PUBLICATIONS

WORX, SD Driver w/ Screw Holder, worx.com/sd-driver-screw-holder-wx2551.html.
GEARFIX, Drill bit holder, gearfix.se.

* cited by examiner

*Primary Examiner* — Mollie Impink
(74) *Attorney, Agent, or Firm* — Westman, Champlin & Koehler, P.A.; Amanda M. Prose

(57) ABSTRACT

A removable, universal, multi-bit holster and method for storing multiple bits, for example, on a hand-held drill. The removable multi-bit holster comprises a cylindrical housing having a first surface and a second, opposing surface and a substantially sold volume there between. The housing comprises a center aperture and a plurality of cavities therein. The plurality of cavities are configured to each receive a drill bit therein. The aperture is configured for engagement with a bit-holder portion of the hand-held drill, such that the cylindrical housing is removably securable to the bit holder of the hand-held drill.

6 Claims, 2 Drawing Sheets

SCREW BIT HOLSTER

BACKGROUND

The present invention relates a screw bit holster. More specifically, this invention relates to a removable screw bit holster for electric hand-held drills.

Generally, additional bits (e.g., drill bits or "screw bits") are stored in a case that accompanies the power tool or the additional bits are stored on the body of the power tool in a unit integral with the power tool.

SUMMARY

An aspect of the present disclosure relates to a multi-bit holster for storing multiple bits on a hand-held drill. The multi-bit holster is a universal holster, meaning the multi-bit holster can be used on various types (e.g., makes and models) of power drills. The multi-bit holster comprises a cylindrical housing having a first surface and a second, opposing surface and a substantially sold volume there between. The housing comprises a center aperture and a plurality of cavities therein. The plurality of cavities are configured to each receive a drill bit therein. The aperture is configured for engagement with a bit-holder portion of the hand-held drill, such that the cylindrical housing is removably securable to the bit holder of the hand-held drill.

The plurality of cavities are circumferentially spaced apart around first surface of the cylindrical housing. The cavities further comprises a magnetic element secured to a floor of each cavity, for further holding a received drill-bit therein.

The aperture has a first diameter and is substantially centered in the second surface of the cylindrical housing and the housing further comprises a counter bore hole approximately centered in the first surface and aligned with the aperture. The counter bore hole has a second diameter that is greater than the first diameter of the aperture, providing a collar in the cylindrical housing where the aperture and bore hole meet.

The multi-bit holster may be comprised of aluminum or a high density plastic material and is configured for removable connection with the bit holder portion of the hand-held drill such that the holster can be removable secured to the hand-held drill. Additionally or alternatively, the multi-bit holster can be used as pocket storage, can be used as storage for multiple bits when removed from the power drill. Thus, the multi-bit holster receives and holds multiple bits and can store these bits for ease of use when the holster is secured to the power drill and when the holster is instead placed in storage, such as in a tool box.

Another aspect of the present disclosure relates to a method of removable holding a plurality of drill-bits on a hand-held drill. The method comprises providing a cylindrical housing having a first surface and a second, opposing surface wherein the housing comprises a center aperture and a plurality of cavities therein. The method further comprises inserting a drill-bit into each one of the plurality of cavities and engaging the aperture with a bit-holder portion of the hand-held drill to removably secure the holster to the hand-held drill.

DETAILED DESCRIPTION

Figure 1:
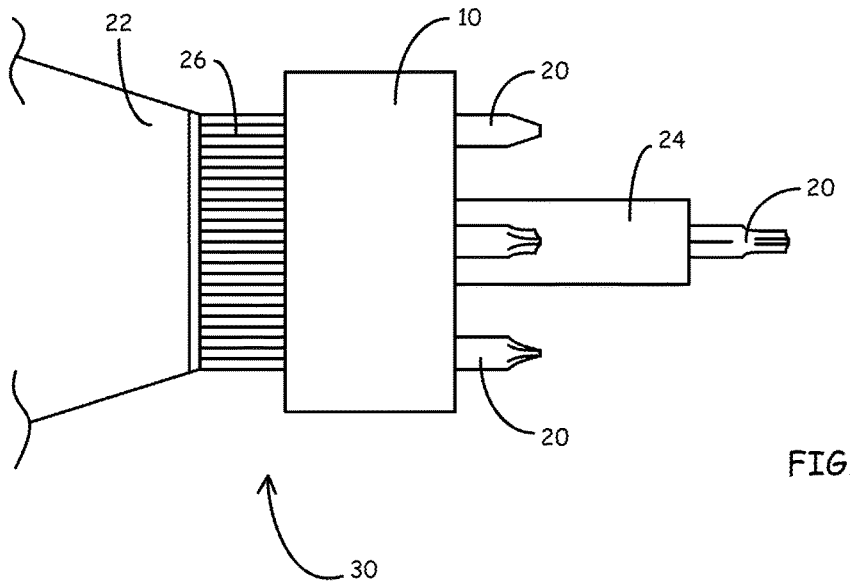
FIG. 1 is a side view of a screw bit holster attached to a hand-held drill.

A multiple bit (e.g., drill-bit or screw-bit) holster is illustrated generally at 10 in FIG. 1. One embodiment, as illustrated in FIG. 1, shows the multiple bit holster 10 secured to a hand-held drill 30. The drill or screw-bit holster 10 is a multi-bit 20 holster 10 and is configured with a plurality of cavities 12, each configured to receive a screw-bit 20. The screw-bit holster 10 is removably mountable on a hand-held drill 30. Thus, the multi-bit holster 10 receives and holds multiple bits 20 and can store these bits 20 for ease of use when the holster 10 is secured to the power drill 30 and also when the holster 10 is instead removed, such as when it is placed in a storage area, such as in a tool box.

The screw-bit holster 10 is constructed of a durable material, examples of which include but are not limited to, aluminum, stainless steel, and high density plastics. The screw-bit holster 10 is generally cylindrical in shape and has a first or top face 13 and a second, opposing or bottom face 15. An aperture 14 extends through the screw-bit holster from the first face 13 to the second face 15 and is substantially centered within a surface area of the faces 13 and 15.

Figure 2:
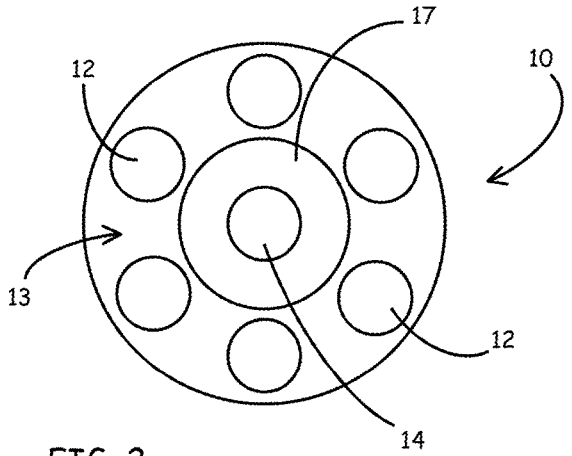
FIG. 2 is a top view of the screw bit holster.
Figure 3:
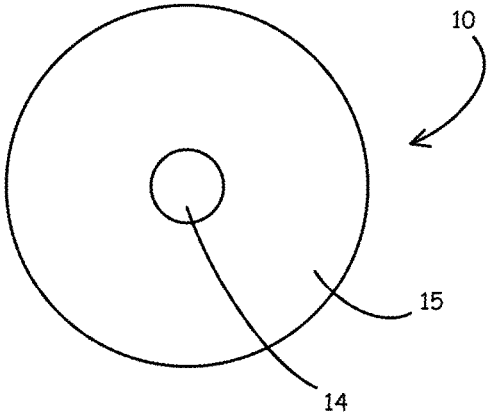
FIG. 3 is a bottom view of the screw bit holster.

As illustrated in FIGS. 2-3, the aperture 14 is configured for engagement with a bit-holder element of the hand-held drill 30 such that the aperture 14 cooperates to enable the removable mounting of the screw-bit holster 10 to the hand-held drill 30. The aperture 14 has a diameter sufficient to allow a standard bit-holder 24 on a hand-held drill 30 to slide through the aperture 14 such that the screw-bit holster 10 can be removable attached and secured when attached to the hand-held drill 30. A counter bore hole 17 surrounds the aperture 14 and is configured to seat against bit holder 24, also referred to as an impact driver bit holder 24. The base of the holster 10 is held between the chuck and the driver tool and cannot be removed until the chuck is released, thus holding the holster 10 is place on various makes and models of drills as selected. The holster 10 is a universal holster than can be used on substantially any power tool having a chuck and driver tool (or like components). Alternatively, the holster 10 can be used as stand-alone storage for additional bits 20.

Figure 4A:
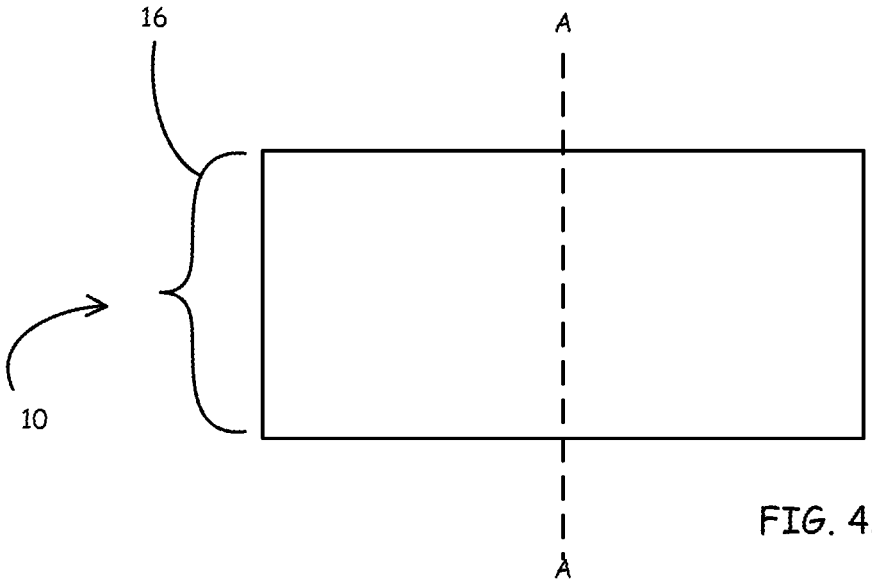
FIG. 4A is a side view of the screw bit holster.
Figure 4B:
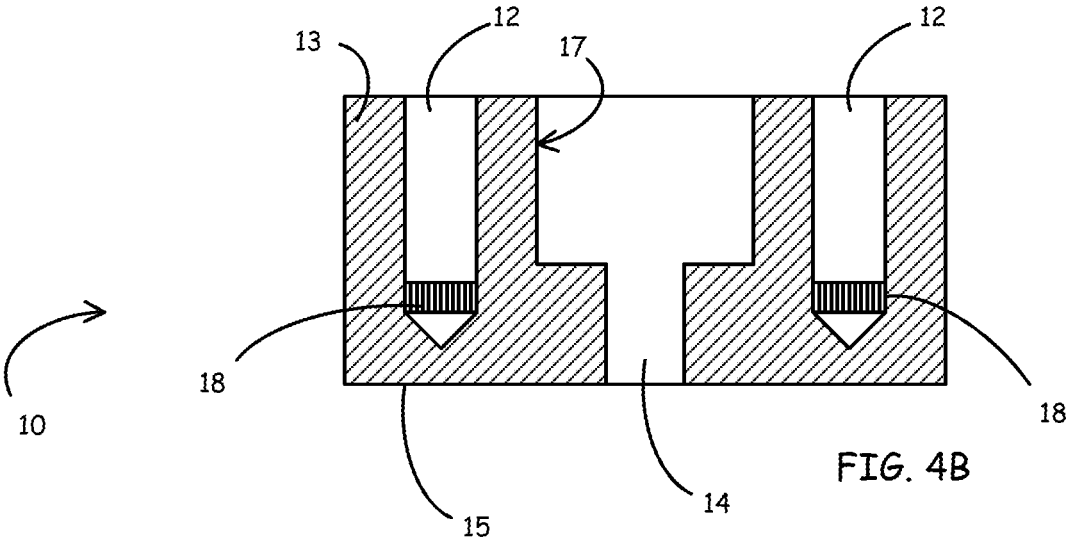
FIG. 4B is a cross-sectional side view of the screw bit holster along line A-A.

The plurality of cavities 12 are spaced apart circumferentially around the aperture 14. As illustrated in FIGS. 4A-4B, each cavity 12 has an opening on the first face 13 of the screw-bit holder and extends into the body of the screw-bit holder towards the second face 15, but does extend all the way through the body of the screw-bit holder 10 such that each cavity 12 is bounded by a floor. The cavities 12 have a diameter sufficient to receive standard screw-bits 20 therein. The cavities 12 each have a depth sufficient to support the screw-bit 20 therein, such that the sides or walls of the cavity 12 are sufficiently deep to support the screw-bit 20 received therein and prevent significant lateral movement of the bit 20 therein.

Each cavity may further include a magnetic puck 18 positioned within the cavity 12 and on the floor of the cavity 12 to further ensure that the drill-bit 20 received in the cavity 12 is held in place. The puck 18 is secured at the base of the cavity 12, and for example, may be glued in the base of the cavity 12.

The screw-bit holster 10 may have any number of spaced apart cavities 12 for storing drill-bits when not in use, in the embodiment illustrated, six cavities 12 are spaced apart around the center aperture 14 for receiving the screw bit holder 24 of the hand-held drill 30. The multi-bit screw-bit holder may include as many as eight or ten cavities or as few as four cavities.

In the embodiment illustrated in figures, the screw-bit holster 10 is an aluminum holster 10 having a depth 16 of approximately ¾ inch. The screw-bit holster 10 is cylindrical in shape, having a diameter of approximately 1¼ inches. There are six spaced apart cavities 12 in the first fast 13 of the screw-bit holster, where the cavities 12 are circumferentially spaced apart around the center aperture 14.

The center aperture 14 is approximately 9/32 inches in diameter. Centered on the aperture is the counter bore hole 17 extending ½ inch from the first face 13 of the holster 10 inwardly towards the second face 15 of the holster 10. Thus, the aperture 14 extends approximately 1¼ inches from its opening in the second face 15 of the screw-bit holster 10 at a diameter of approximately 9/32 inches and the aperture is expanded to a diameter of 7/16 inches at the counter bore hole 17.

The cavities 12 are positioned around the counter bore hole 17 and the aperture 14 and each cavity 12 is approximately 9/32 inches in diameter and extends inwardly from the first face 13 of the screw-bit holster 10 a depth of approximately ⅝ inches. The puck magnet 18 is positioned and secured to the bottom of the cavity 12. The cavities 12, also referred to as bit-holes, are positioned on the face 13 of the screw-bit holster 10 such that the diameter of the center of the cavities 12 is approximately ¾ inches.

Referring back to FIG. 1, the screw -bit holster 10 can removably mounted on to various pre-existing hand-held drills, and is mounted on the screw bit holder, in a position forward of the chuck of the drill 30. The aperture 14 in the screw-bit holster 10 allows the screw-bit holster 10 to be secured to the screw bit holder of a standard drill. This allows the screw-bit holster 10 to be used on more than one type of drill.

Although the present disclosure has been described with reference to preferred embodiments, workers skilled in the art will recognize that changes may be made in form and detail without departing from the spirit and scope of the disclosure.

The invention claimed is:

1. A multi-bit holster for storing on a hand-held drill, the multi-bit holder comprising:

a cylindrical housing having a first surface and a second, opposing surface, and a volume therebetween, wherein the cylindrical housing comprises a center aperture and a plurality of cavities therein, wherein the center aperture has a first diameter and is substantially centered in the second surface of the cylindrical housing and wherein the center aperture extends into a counter bore hole approximately centered in the first surface, where the counter bore hole has a second diameter that is greater than the first diameter of the center aperture with a ratio of the first diameter to the second diameter being approximately 4.5:7 for; providing a collar in the cylindrical housing where the center aperture and counter bore hole meet, wherein each of the cavities are configured to removably receive a drill bit therein and each cavity comprising a magnetic element secured to a floor of each cavity for holding a received drill-bit therein, and wherein the center aperture is configured for engagement with a bit-holder portion of the hand-held drill, such that the cylindrical housing is removably securable to the bit holder of the hand-held drill, and wherein the plurality of cavities extend into the cylindrical housing from the first surface.

2. The multi-bit holster of claim 1, wherein the plurality of cavities are circumferentially spaced apart around the first surface of the cylindrical housing.

3. The multi-bit holster of claim 1, wherein the multi-bit holster is comprised of aluminum or high-density plastic.

4. The multi-bit holster of claim 1, wherein the plurality of cavities comprises six cavities extending into the cylindrical housing.

5. The multi-bit holster of claim 1 wherein the counter bore hole and the center aperture cooperate to secure the multi-bit holster onto a length of the bit-holder component of the hand-held drill.

6. The multi-bit holster of claim 5, wherein the multi-bit holster is removable from the hand-held drill.

* * * * *